US011421176B2

(12) United States Patent
Yoshizaki et al.

(10) Patent No.: US 11,421,176 B2
(45) Date of Patent: Aug. 23, 2022

(54) GREASE COMPOSITION AND HUB UNIT

(71) Applicants: JTEKT CORPORATION, Osaka (JP); KYODO YUSHI CO., LTD., Fujisawa (JP)

(72) Inventors: Koji Yoshizaki, Osaka (JP); Hiroshi Inukai, Osaka (JP); Yoichiro Sankai, Osaka (JP); Shinji Yamane, Osaka (JP); Hideo Shibata, Osaka (JP); Hirofumi Inoue, Osaka (JP); Ryuji Nakata, Osaka (JP); Junichi Imai, Kanagawa (JP); Yutaka Imai, Kanagawa (JP); Ryosuke Saito, Kanagawa (JP); Yuta Sato, Kanagawa (JP)

(73) Assignees: JTEKT CORPORATION, Osaka (JP); KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 16/337,134

(22) PCT Filed: Sep. 28, 2016

(86) PCT No.: PCT/JP2016/078746
§ 371 (c)(1),
(2) Date: Mar. 27, 2019

(87) PCT Pub. No.: WO2018/061134
PCT Pub. Date: Apr. 5, 2018

(65) Prior Publication Data

US 2019/0218474 A1 Jul. 18, 2019

(51) Int. Cl.
*C10M 169/04* (2006.01)
*C10M 169/00* (2006.01)
(Continued)

(52) U.S. Cl.
CPC ..... *C10M 169/00* (2013.01); *C10M 115/08* (2013.01); *C10M 137/08* (2013.01);
(Continued)

(58) Field of Classification Search
CPC ..... C10M 169/00; C10M 169/06; C10M 115/08; C10M 137/08; C10M 159/06;
(Continued)

(56) References Cited

U.S. PATENT DOCUMENTS 6,329,327 B1 * 12/2001 Tanaka ..... C10M 125/10 508/362
2005/0256014 A1 * 11/2005 Sherman ..... C10M 171/008 508/579
(Continued)

FOREIGN PATENT DOCUMENTS

EP 3 187 572 A1 7/2017
JP 2008-542502 A 11/2008
(Continued)

OTHER PUBLICATIONS

Nov. 15, 2016 International Search Report issued in International Patent Application No. PCT/JP2016/078746.
(Continued)

*Primary Examiner* — Taiwo Oladapo
(74) *Attorney, Agent, or Firm* — Oliff PLC

(57) ABSTRACT

A grease composition includes a base oil, a thickener, and an additive. The base oil contains a synthetic oil. The thickener contains a compound having a urea group. The additive contains a phosphoric compound, a calcium-based compound, and a hydrocarbon-based wax. A hub unit includes the grease composition enclosed therein.

16 Claims, 3 Drawing Sheets

(51) Int. Cl.

| | |
|---|---|
| ***C10M 115/08*** | (2006.01) |
| ***C10M 137/08*** | (2006.01) |
| ***C10M 159/24*** | (2006.01) |
| ***C10M 143/02*** | (2006.01) |
| ***C10M 169/06*** | (2006.01) |
| *C10M 137/00* | (2006.01) |
| *C10M 143/00* | (2006.01) |
| *C10N 10/04* | (2006.01) |
| *C10N 20/02* | (2006.01) |
| *C10N 40/02* | (2006.01) |
| *C10N 50/10* | (2006.01) |

(52) U.S. Cl.
CPC ..... *C10M 143/02* (2013.01); *C10M 159/24* (2013.01); *C10M 169/06* (2013.01); *C10M 137/00* (2013.01); *C10M 143/00* (2013.01); *C10M 2205/14* (2013.01); *C10M 2215/1026* (2013.01); *C10M 2223/043* (2013.01); *C10N 2010/04* (2013.01); *C10N 2020/02* (2013.01); *C10N 2040/02* (2013.01); *C10N 2050/10* (2013.01)

(58) Field of Classification Search
CPC ..... C10M 159/24; C10M 143/02; C10M 137/00; C10M 143/00; C10M 2205/14; C10M 2215/1026; C10M 2223/043; C10N 2010/04; C10N 2020/02; C10N 2040/02; C10N 2050/10; C10N 2030/06
See application file for complete search history.

(56) References Cited

U.S. PATENT DOCUMENTS

| | | | | |
|---|---|---|---|---|
| 2006/0154831 | A1* | 7/2006 | Iwano | C10M 159/24 508/390 |
| 2006/0276352 | A1 | 12/2006 | Vinci | |
| 2007/0149422 | A1* | 6/2007 | Miyajima | C10M 159/06 508/451 |
| 2008/0176776 | A1* | 7/2008 | E | C10M 169/06 508/376 |
| 2009/0003746 | A1* | 1/2009 | Norimatsu | F16C 33/4676 384/454 |
| 2012/0314985 | A1* | 12/2012 | Saita | F16C 33/6633 384/490 |
| 2014/0199009 | A1* | 7/2014 | Inami | C10M 169/02 384/462 |
| 2015/0299610 | A1 | 10/2015 | Ohyama | |
| 2017/0275558 | A1 | 9/2017 | Saito et al. | |

FOREIGN PATENT DOCUMENTS

| | | | | |
|---|---|---|---|---|
| JP | 4566909 | B2 | 10/2010 | |
| JP | 2014-118467 | A | 6/2014 | |
| JP | 2016-050234 | A | 4/2016 | |
| WO | 2014/092201 | A1 | 6/2014 | |
| WO | WO-2014092201 | A * | 6/2014 | F16C 33/6633 |

OTHER PUBLICATIONS

Nov. 15, 2016 Written Opinion issued in International Patent Application No. PCT/JP2016/078746.
May 11, 2020 Office Action issued in German Patent Application No. 11 2016 007 278.3.

* cited by examiner

GREASE COMPOSITION AND HUB UNIT

TECHNICAL FIELD

An aspect of the present invention relates to a grease composition and a hub unit in which the grease composition is enclosed.

BACKGROUND ART

In the related art, a grease composition disclosed in Patent Literature 1 or Patent Literature 2 has been known as a lubricant for use in a bearing of an automobile or the like. Patent Literature 1 discloses a grease composition containing a thickener, a base oil, and an amine phosphate.

Patent Literature 2 discloses a lubricating composition including (a) an oil soluble phosphorus amine salt, (b) about 0.0001 weight % to about 5 weight % of a metal containing detergent package including a phenate and a sulfonate, (c) a dispersant, (d) a dispersant viscosity modifier, (e) a metal deactivator, and (f) an oil of lubricating viscosity, in which the lubricating composition contains less than about 0.25 weight % of a metal dialkyldithiophosphate, and the lubricating composition is a transmission oil, a driveshaft oil, a gear oil, an axle oil or mixtures thereof.

CITATION LIST

Patent Literature

Patent Literature 1: WO-A1-2014/092201
Patent Literature 2: JP-A-2008-542502

SUMMARY OF INVENTION

Technical Problem

Grease to be used is selected depending on its use conditions (kind of machine, operating conditions, service temperature range, etc.). For example, grease containing a middle-viscosity base oil having kinematic viscosity at 40° C. of about 70 to 100 $mm^2/s$ is used as grease for a hub unit of an automobile. Such a kind of grease contributes to prevention of seizure in a bearing of the hub unit or a lubrication life of the bearing maintained for a long time.

On the other hand, in recent years, excellent fuel economy has been required for automobiles due to growing interest in global warming, etc.

In order to improve the fuel economy, it is necessary to use a low-viscosity base oil as grease to thereby reduce frictional resistance in a sliding part (raceway contact part) of a bearing as low as possible. However, when the low-viscosity base oil is simply used, it is difficult, as antinomy, to maintain the seizure resistance or the long-time lubrication life of the bearing.

In addition, with expansion of the automobile market to cold districts over the world, there are concerns that low-temperature fretting may be generated in a sliding part of a bearing due to vibration during transportation. Under a low temperature environment, grease may be solidified easily so that a base oil of the grease cannot spread to the sliding part.

Therefore, an object in one aspect of the present invention is to provide a grease composition capable of both reducing frictional resistance in a sliding part and maintaining seizure resistance and a long-time lubrication life, and capable of reducing occurrence of fretting under a low temperature environment, and a hub unit including the grease composition.

Solution to Problem

A grease composition in an aspect of the present invention in order to solve the above problem(s) includes a base oil, a thickener, and an additive, and the base oil contains a synthetic oil, the thickener contains a compound having a urea group, and the additive contains a phosphoric compound, a calcium-based compound, and a hydrocarbon-based wax (first embodiment).

In the grease composition in an aspect of the present invention, it is preferred that the compound having a urea group includes a diurea represented by the following formula (A) (second embodiment).

[Chem. 1]

Formula (A)

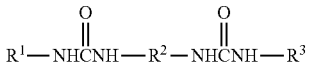

In the formula, $R^2$ represents a diphenylmethane group, each of N atoms bonded to each of phenyl groups of $R^2$ is located at the para position of a methylene group of the diphenylmethane group, $R^1$ and $R^3$ are the same or different functional groups and each represent a cyclohexyl group or a linear or branched alkyl group having 16 to 20 carbon atoms, and a ratio of the number of moles of cyclohexyl group to the total number of moles of cyclohexyl group and alkyl group [{(number of cyclohexyl groups)/(number of cyclohexyl groups+number of alkyl groups)}×100] is 50 to 90 mol %.

In the grease composition in an aspect of the present invention, it is preferred that the base oil has a kinematic viscosity at −30° C. of 5000 $mm^2/s$ or less (third embodiment).

In the grease composition in an aspect of the present invention, it is preferred that the base oil has a kinematic viscosity at 40° C. of 20 to 50 $mm^2/s$ (fourth embodiment).

In the grease composition in an aspect of the present invention, it is preferred that: the phosphoric compound is an amine phosphate; and a content of the amine phosphate in the grease composition is 0.05 to 5 mass % (fifth embodiment).

In the grease composition in an aspect of the present invention, it is preferred that: the calcium-based compound is an overbased calcium sulfonate; the overbased calcium sulfonate has a base number of 50 to 500 mgKOH/g; and a content of the overbased calcium sulfonate in the grease composition is 0.05 to 5 mass % (sixth embodiment).

In the grease composition in an aspect of the present invention, it is preferred that: the hydrocarbon-based wax is a polyethylene wax; and a content of the polyethylene wax in the grease composition is 0.05 to 5 mass % (seventh embodiment).

In the grease composition in an aspect of the present invention, it is preferred that: the synthetic oil is a mixed oil including a synthetic hydrocarbon oil and an ester oil; and a ratio of the ester oil to the mixed oil is 5 to 15 mass % (eighth embodiment).

In the grease composition in an aspect of the present invention, it is preferred that a content of the compound having a urea group in the grease composition is 5 to 15 mass % (ninth embodiment).

In a hub unit in an aspect of the present invention, the grease composition in the present invention is enclosed (tenth embodiment).

Advantageous Effects of Invention

According to the grease composition in one aspect of the present invention, occurrence of fretting in a low temperature environment (low-temperature fretting) can be reduced. In addition, seizure resistance and long-lasting lubrication life of sliding part can be maintained. In addition, frictional resistance in the sliding part can be reduced.

Accordingly, according to the hub unit including the grease composition in one aspect of the present invention, frictional resistance of a shaft supported by a bearing can be reduced to reduce rotational torque, so that it is possible to improve fuel economy of the vehicle. Not to say, it is possible to maintain seizure resistance and a long-time lubrication life of the bearing, and it is also possible to reduce occurrence of fretting when the vehicle is transported (for example, by rail, truck or the like) in a cold district.

DESCRIPTION OF EMBODIMENTS

Figure 1:
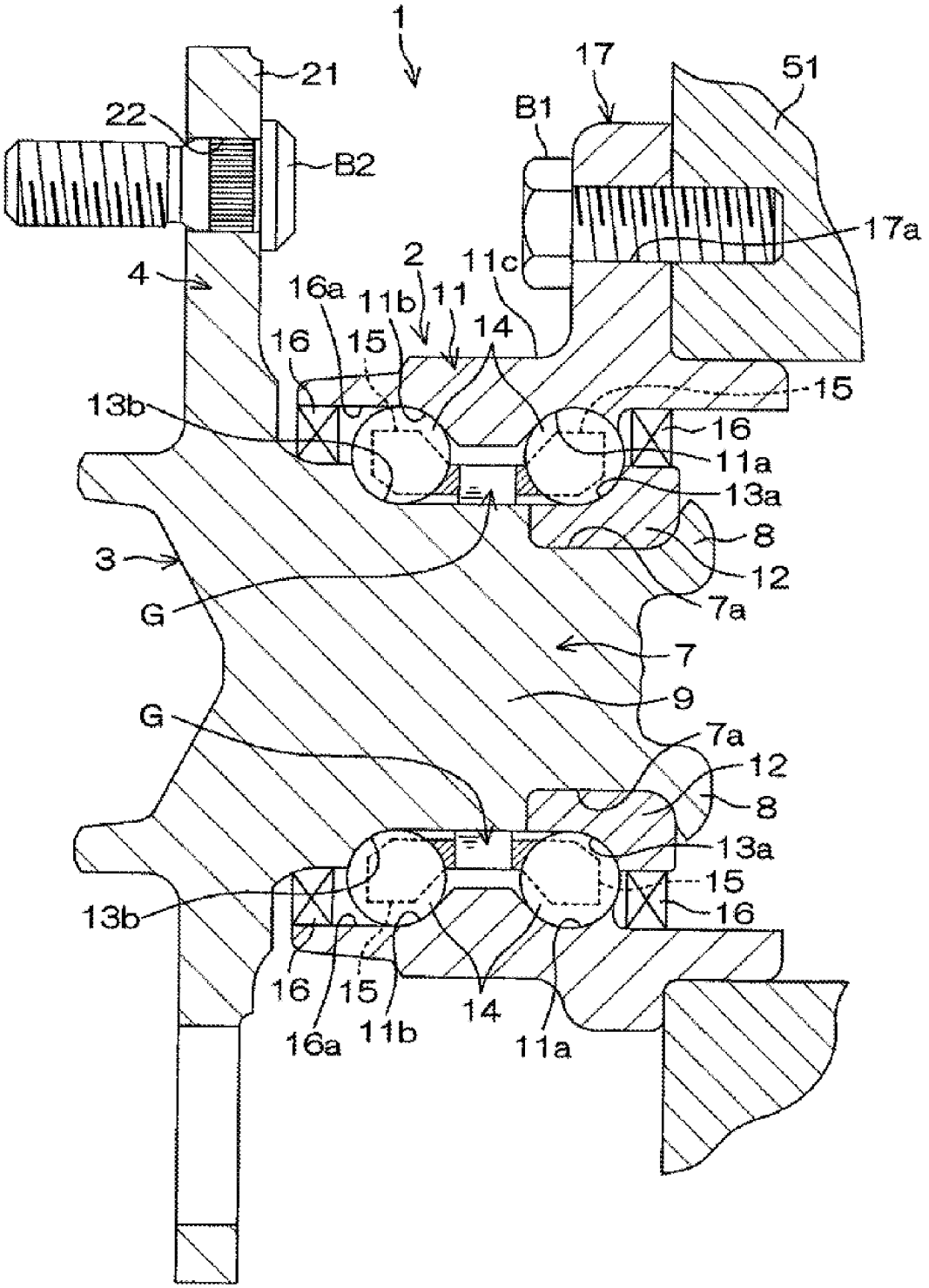
FIG. 1 is a sectional view of a hub unit according to an embodiment of the present invention.

A grease composition in an aspect of the present invention contains a base oil, a thickener, and an additive.

The base oil that may be used in the grease composition in the aspect of the present invention essentially contains a synthetic oil but may also include other base oils such as a mineral oil. The synthetic oil may be used singly, or in combination of two or more kinds thereof. In addition, there is no particular limitation on base oil other than the synthetic oil. In particular, in the case of the synthetic oil, impurities are not mixed, or even if impurities are mixed, the amount thereof is small so that the lubrication performance of the grease composition can be improved. Also, depending on a molecular weight or molecular structure, kinematic viscosity and pour point of the base oil may be selected in a wide range.

Examples of the synthetic oil include synthetic hydrocarbon oil, ester oil, silicone oil, fluorine oil, phenyl ether oil, polyglycol oil, alkylbenzene oil, alkylnaphthalene oil, biphenyl oil, diphenyl alkane oil, di(alkylphenyl) alkane oil, polyglycol oil, polyphenyl ether oil, and fluorine compounds such as perfluoropolyether and fluorinated polyolefin. Of these, the synthetic hydrocarbon oil and the ester oil are preferably used, and oils obtained by mixing synthetic hydrocarbon oil and ester oil are more preferably used.

More specifically, examples of the synthetic hydrocarbon oil include those obtained by polymerizing one or two or more kinds of α-olefins produced using ethylene, propylene, butene, a derivative thereof or the like as a raw material. Preferable examples of the α-olefin include those having 6 to 18 carbon atoms, and more preferable examples thereof include poly-α-olefin (PAO) which is an oligomer of 1-decene or 1-dodecene.

Examples of the ester oil include diesters such as dibutyl sebacate, di-2-ethylhexyl sebacate, and dioctyl adipate, aromatic esters such as trioctyl trimellitate, tridecyl trimellitate, and tetraoctyl pyromellitate, and polyol esters such as trimethylolpropane caprylate, trimethylolpropane pelargonate, and pentaerythritol ester.

Regarding the physical properties of the base oil, the following range is preferable. That is, the kinematic viscosity at 40° C. (in accordance with JIS K 2283) is preferably 20 to 50 $mm^2/s$, and more preferably 30 to 50 $mm^2/s$. In addition, the kinematic viscosity at −30° C. (in accordance with JIS K 2283) is preferably 5000 $mm^2/s$ or less. In a case where the kinematic viscosity of the base oil falls within the above range, it is possible to reduce the frictional resistance in the sliding part of the bearing, as compared to the grease composition in which a base oil having a kinematic viscosity at 40° C. of 70 to 100 $mm^2/s$ is used. The pour point (in accordance with JIS K 2269) is preferably −50° C. or lower, more preferably −70° C. to −50° C. In a case where the pour point of the base oil falls within the above range, fluidity of the grease composition can be ensured in a low temperature environment (for example, −40° C. or lower), so that the base oil can be easily reached in the sliding part of the bearing. Therefore, the effect of reducing occurrence of low temperature fretting can be improved. Further, the traction coefficient is preferably 0.1 or less, more preferably 0.03 to 0.07. In a case where the traction coefficient of the base oil falls within the above range, frictional resistance in the bearing sliding part can be reduced.

In a case where the base oil is a mixture of the synthetic hydrocarbon oil and the ester oil, it is preferable that the synthetic hydrocarbon oil is contained in an amount of 85 to 95 mass % and the ester oil is contained in an amount of 5 to 15 mass %.

Further, the content of the base oil is preferably from 85 to 95 mass %, and more preferably from 88 to 92 mass %, based on the total amount of the grease composition.

As a thickener, a compound having a urea group is used. Examples of the compound having a urea group include a compound having a urea group such as polyurea represented by diurea, triurea or tetraurea, a compound having a urea group and a urethane group, a compound having a urethane group such as diurethane, a mixture thereof, and the like. Of these, diurea is preferably used, and diurea obtained by reacting a mixed amine of alicyclic amine and aliphatic amine with diisocyanate is more preferably used. With a diurea in this combination, it is possible to reduce the mass % of the thickener for obtaining the grease composition having the same consistency, and it is possible to reduce the frictional resistance in the bearing sliding part.

Examples of the alicyclic amine include cyclohexylamine, and dicyclohexylamine, and examples of the aliphatic amine include linear or branched alkyl amines having 16 to 20 carbon atoms.

Examples of the diisocyanate include aliphatic diisocyanates, alicyclic diisocyanates, and aromatic diisocyanates. Examples of the aliphatic diisocyanates include a diisocyanate having a saturated and/or unsaturated linear or branched hydrocarbon group. Specific examples thereof include octadecane diisocyanate, decane diisocyanate, and hexane diisocyanate (HDI). Examples of the alicyclic diisocyanate include cyclohexyl diisocyanate, and dicyclohexyl methane diisocyanate. Examples of the aromatic diisocyanate include phenylene diisocyanate, tolylene diisocyanate (TDI), diphenyl diisocyanate, and 4,4'-diphenylmethane diisocyanate (MDI). Of these, aromatic diisocyanates are preferably used, and 4,4'-diphenylmethane diisocyanate (MDI) is more preferably used.

In a case where the mixed amine of an alicyclic amine and an aliphatic amine is used as a raw material for the compound having a urea group, the mixing ratio (molar ratio) between the alicyclic amine and the aliphatic amine is preferably "alicyclic amine:aliphatic amine=50:50 to 90:10".

The mixed amine and the diisocyanate can be reacted under various methods and conditions. The mixed amine and the diisocyanate are preferably reacted in the base oil to obtain a diurea with high homogeneous dispersibility of the thickener. In addition, the reaction may be carried out by adding the base oil in which the diisocyanate is dissolved to the base oil in which the mixed amine is dissolved, or by adding the base oil in which the mixed amine is dissolved to the base oil in which the diisocyanate is dissolved. The temperature and time in these reactions are not particularly limited and may be the same as ordinary reactions of this kind. The reaction initiation temperature is preferably from 25° C. to 100° C. from the viewpoint of the volatility of the mixed amine. The reaction temperature is preferably from 60° C. to 170° C. from the viewpoint of solubility and volatility of the mixed amine and diisocyanate. The reaction time is preferably from 0.5 to 2.0 hours from the viewpoint of completing the reaction between the mixed amine and the diisocyanate and improving the efficiency by shortening the production time.

The diurea obtained by the above method is preferably represented by, for example, the following formula (A).

[Chem. 2]

Formula (A)

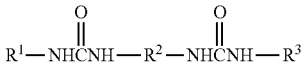

(In the formula, $R^1$ represents a diphenylmethane group, each of N atoms bonded to each of phenyl groups of $R^1$ is located at the para position of a methylene group of the diphenylmethane group, $R^1$ and $R^3$ are the same or different functional groups and each represent a cyclohexyl group or a linear or branched alkyl group having 16 to 20 carbon atoms, and a ratio of the number of moles of cyclohexyl group to the total number of moles of cyclohexyl group and alkyl group [{(number of cyclohexyl groups)/(number of cyclohexyl groups+number of alkyl groups)}×100] is 50 to 90 mol %.)

The content of the thickener is preferably from 5 to 15 mass %, and more preferably from 8 to 12 mass %, based on the total amount of the grease composition.

Examples of the additive as essential components include a phosphoric compound, a calcium-based compound, and a hydrocarbon-based wax, and examples of the additives as optional components include various additives such as an extreme pressure agent, a rust inhibitor, an antioxidant, an antiwear agent, a dye, a color stabilizer, a thickener, a structure stabilizer, a metal deactivator, and a viscosity index improver.

Examples of the phosphoric compounds include phosphorous acid ester (phosphites), phosphoric acid ester (phosphates), salts of these esters with amines, alkanolamines or the like, and amine phosphates are preferably used. Examples of the amine phosphates include tertiary alkylamine-dimethyl phosphate, and phenylamine-phosphate.

Examples of the calcium-based compound include a calcium salt of an organic sulfonic acid (calcium sulfonate). The calcium sulfonate is not particularly limited, and examples thereof include a compound represented by the following general formula (B).

[Chem. 3]

$$[R^1—SO_3]_2Ca \quad (B)$$

(In the formula, $R^1$ represents an alkyl group, an alkenyl group, an alkylnaphthyl group, a dialkylnaphthyl group, an alkylphenyl group or a high boiling point fraction residue group of petroleum. The alkyl or alkenyl is linear or branched, and has 2 to 22 carbon atoms. $R^1$ is preferably an alkylphenyl group having an alkyl group having preferably 6 to 18 carbon atoms, more preferably 8 to 18, and particularly preferably 10 to 18 carbon atoms.)

Of the compounds represented by the general formula (B), preferred one is an overbased calcium sulfonate having a base number (in accordance with JIS K 2501) of 50 to 500 mgKOH/g, more preferably 300 to 500 mgKOH/g. With the overbased calcium sulfonate, a strong coating can be formed on the surface of the sliding part, and the separation life can thus be improved. The overbased calcium sulfonate includes calcium sulfonate and calcium carbonate.

In a case where the amine phosphate is used as the phosphoric compound, the content thereof is preferably 0.05 to 5 mass %, and more preferably 0.5 to 2 mass %, based on the total amount of the grease composition. In a case where the overbased calcium sulfonate is used as the calcium-based compound, the content thereof is preferably 0.05 to 5 mass %, and more preferably 0.5 to 3 mass %, based on the total amount of grease composition.

Examples of the hydrocarbon-based wax include polymer compounds such as polyethylene wax and polypropylene wax, and Fischer-Tropsch wax. The polyethylene wax may be obtained, for example, by polymerization of ethylene or thermal decomposition of polyethylene.

In a case where polyethylene wax is used as the hydrocarbon-based wax, the content thereof is preferably 0.05 to 5 mass %, more preferably 0.5 to 2 mass %, based on the total amount of grease composition.

The grease composition in the present invention may be prepared, for example, by mixing, as an essential component, a synthetic oil (base oil), a urea-based thickener, a phosphoric compound, a calcium-based compound, and a hydrocarbon-based wax and if needed, other additive(s), and stirring the mixture, and then causing the stirred mixture to pass through a roll mill or the like.

Although the mechanism of reducing occurrence of fretting in a low temperature environment, and the mechanism of maintaining seizure resistance and long-time lubrication life of the sliding part is still unknown, the following inference is conceivable at the present stage.

According to the grease composition of the present invention, the phosphoric compound is well adsorbed onto metals, and a surface film of a compound derived from the phosphoric compound is formed on the metal surface of the sliding part of bearing or the like. In addition, since the calcium-based compound is contained, a cured film of the calcium-based compound (surface cured film) is formed on the surface film of the phosphoric compound, and the hydrocarbon-based wax adsorbs favorably thereon, thereby forming a film of the hydrocarbon-based wax on the cured film. Here, examples of the compound "derived from the phosphoric compound" includes a phosphoric inorganic compound derived by the reaction of a phosphoric compound with a metal surface, and the like.

The metal surface is thinly coated with the surface film of the phosphoric compound (which is a film softer than the cured film of the calcium-based compound), and the cured film of the calcium-based compound. Thus, even if vibration occurs in a state where the base oil does not reach the sliding part, it is possible to eliminate the contact between the metal surfaces or to reduce the impact due to the contact. Therefore, occurrence of fretting in a low temperature environment (low temperature fretting) can be reduced. Furthermore, during sliding on the metal surface, lubrication by an oil film derived from the base oil that is drawn into the sliding part can be assisted by a film derived from the additive (hydrocarbon-based wax). That is, even if the elastic fluid lubrication film of the base oil is thin, by combining with the film derived from the hydrocarbon-based wax, the seizure resistance and long-time lubrication life of the sliding part can be maintained. In addition, the frictional resistance in the sliding part can be reduced.

Next, a hub unit 1 in which the grease composition of the present invention is enclosed as grease (G) is described with reference to the accompanying drawings.

FIG. 1 is a sectional view of a hub unit 1 according to an embodiment of the present invention. The left/right direction of FIG. 1 is referred to as an axial direction of the hub unit 1, while the left side of FIG. 1 is referred to as an axially outer side, and the right side of FIG. 1 is referred to as an axially inner side.

For example, a hub unit 1 rotatably supports wheels of an automobile with respect to a suspension device on the vehicle body side. The hub unit 1 includes a rolling bearing 2, a hub wheel 3 serving as a bearing ring member of the rolling bearing 2, and an annular flange portion 4 provided integrally with the hub wheel 3. The hub wheel 3 and the flange portion 4 of this embodiment are made of, for example, a hot forged steel material.

The hub wheel 3 includes a small diameter portion 7, a caulking portion 8, and a large diameter portion 9. The small diameter portion 7 has a circular shape in section. In the caulking portion 8, an axially inner end portion of the small diameter portion 7 is bent and deformed radially outward. The large diameter portion 9 has a circular shape in section with a larger diameter than the small diameter portion 7 and is provided continuously and axially outward from the small diameter portion 7. In the large diameter portion 9 of the hub wheel 3, the flange portion 4 is bent and formed to extend radially outward from an outer circumferential surface of the large diameter portion 9.

The rolling bearing 2 is, for example, a double-row ball bearing, which includes an outer ring 11 and an inner ring member 12. The outer ring 11 has a pair of outer ring raceway surfaces 11*a* and 11*b* in its inner circumferential surface. The inner ring member 12 is inserted and fitted so that an inner circumferential surface of the inner ring member 12 can come in close contact with an outer circumferential surface 7*a* of the small diameter portion 7 of the hub wheel 3. The inner ring member 12 has an inner ring raceway surface 13*a* in its outer circumferential surface. The inner ring raceway surface 13*a* faces the outer ring raceway surface 11*a* located on the axially inner side. The large diameter portion 9 of the hub wheel 3 has an inner ring raceway surface 13*b* in its outer circumferential surface. The inner ring raceway surface 13*b* faces the outer ring raceway surface 11*b* on the axially outer side. The outer ring 11 and the inner ring member 12 are made of a steel material.

In addition, the rolling bearing 2 includes a plurality of balls (rolling elements) 14, and a pair of cages 15. The balls 14 are disposed in two rows rollably between the outer ring raceway surface 11*a* and the inner ring raceway surface 13*a* and between the outer ring raceway surface 11*b* and the inner ring raceway surface 13*b*, respectively. The balls 14 disposed in two rows are retained at predetermined circumferential intervals by the pair of cages 15, respectively. The balls 14 are made of steel material.

In addition, the rolling bearing 2 includes a seal member 16. An annular space formed by the hub wheel 3 and the outer ring 11 is sealed from axially opposite ends of the rolling bearing 2 by the seal member 16. In the annular space 16*a* sealed by the seal member 16, the grease G composed of the aforementioned grease composition is enclosed.

Further, the rolling bearing 2 has a bearing flange 17 extending radially outward from the outer circumferential surface 11*c* of the outer ring 11. A plurality of bolt holes 17*a* are formed in the bearing flange 17 so as to penetrate the bearing flange 17 in its thickness direction. Bolts B1 are inserted into the bolt holes 17*a*, and screwed down to knuckles 51 of the suspension device. Thus, the bearing flange 17 is fixed to the knuckles 51.

Figure 2:
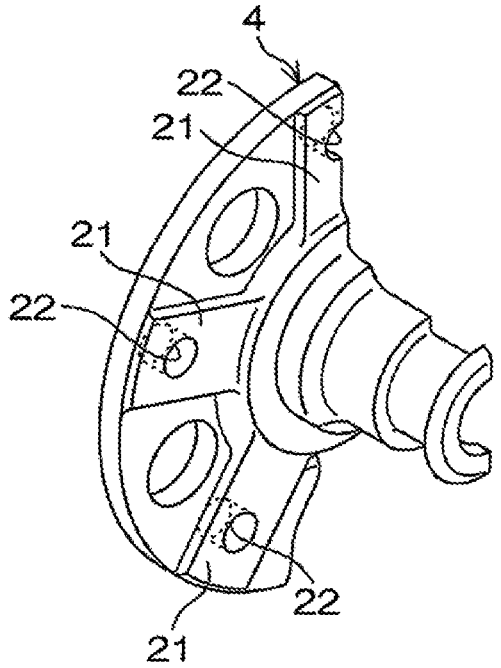
FIG. 2 is a perspective view of a flange portion of the hub unit.
Figure 3:
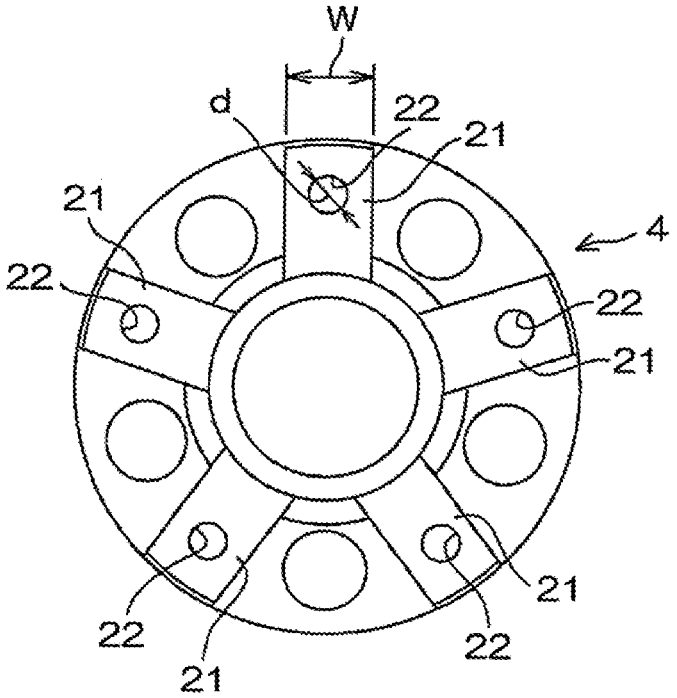
FIG. 3 is a front view of the flange portion.

FIG. 2 is a perspective view of the flange portion 4. FIG. 3 is a front view of the flange portion 4.

In FIG. 2 and FIG. 3, the flange portion 4 has a plurality (five in the embodiment) of thick portions 21 formed at predetermined intervals in the circumferential direction of the flange portion 4. Each thick portion 21 is formed so that an axially inner end surface of the thick portion 21 are raised, while the thick portion 21 is formed to extend radially in the radial direction in front view of FIG. 3. In addition, each thick portion 21 has a predetermined width W in the circumferential direction (hereinafter referred to as circumferential width W).

One bolt hole 22 is formed on the radially outer side of each thick portion 21 so as to penetrate the thick portion 21 in the thickness direction and at a substantially central portion of the circumferential width W. A hub bolt B2 for attaching a wheel or a brake disc is fixed to each bolt hole 22 by press fitting, as shown in FIG. 1. Accordingly, a diameter d (see FIG. 3) of the bolt hole 22 is set at a dimension with which the hub bolt B2 can be press-fitted into the bolt hole 22.

In this manner, according to the hub unit 1, the phosphoric compound in the grease (G) has good adsorptivity to metals. Thus, a surface film formed of a compound (such as iron phosphate (II)) derived from the phosphoric compound is formed on the outer ring raceway surface 11*a* and inner ring raceway surface 13*a* of the rolling bearing 2 due to reaction with the metal. Furthermore, since the calcium-based compound is contained therein, the cured film of the calcium-based compound is formed on the surface film of the phosphoric compound, which adsorbs the hydrocarbon-based wax well thereon. This forms the film of hydrocarbon-based wax on the cured film.

The outer ring raceway surface 11*a* and the inner ring raceway surface 13*a* are thinly coated with the surface film of the phosphoric compound and the cured film of the calcium-based compound. It is possible to prevent contact of the metal between the surface of each ball 14 and the outer ring raceway surface 11*a* or the inner ring raceway surface 13*a* or to reduce impact by the contact even when vibration occurs in a state where the base oil has not spread to the outer ring raceway surface 11*a* or the inner ring raceway surface 13*a* yet. Accordingly, occurrence of fretting in a low temperature environment (low-temperature fretting) can be reduced. Thus, occurrence of fretting can be reduced when a vehicle is transported (for example, by rail, truck or the like) in a cold district.

Further, when the rolling bearing 2 is rotating, lubrication by the oily film derived from the base oil drawn in a space between the surface of each ball 14 and the outer ring raceway surface 11*a* or the inner ring raceway surface 13*a* can be assisted by the film derived from the hydrocarbon-based wax. That is, even when the elastic fluid lubrication film of the base oil is thin, the seizure resistance and long-time lubrication life of the sliding part can be maintained by cooperation with the film derived from the hydrocarbon-based wax. Therefore, when a base oil having low kinematic viscosity is used, frictional resistance in the sliding part can be reduced. Thus, the frictional resistance in the shaft supported by the rolling bearing 2 can be reduced to reduce the rotational torque, and thus, the fuel economy of the vehicle can be improved.

The present invention is not limited to the aforementioned embodiment but may be carried out along another embodiment.

For example, although an example in which the grease (G) is enclosed in the rolling bearing 2 constituted of a (double-row) ball bearing is described in the aforementioned embodiment, a bearing in which a grease constituted of the grease composition of the present invention is enclosed may be another rolling bearing such as a needle bearing or a roller bearing using other members than the balls as rolling elements.

In addition, a bearing in which a grease constituted of the grease composition of the present invention is enclosed may be mounted on a rolling device for a vehicle other than the aforementioned hub unit 1, for example, a suspension unit, a steering unit, etc. Further, various changes on design may be made within the scope described in the claim(s).

EXAMPLES

Next, one aspect of the present invention is described based on examples and comparative examples. However, the present invention is not limited to the following examples.

Examples 1 to 3 and Comparative Examples 1 to 3

<Preparation of Grease Composition>

A thickener, a base oil and a phosphoric compound, a calcium-based compound and a hydrocarbon-based wax were mixed at each mixing ratio shown in Table 1 in each of Examples and Comparative Examples, and thus, each grease composition for testing was prepared. The obtained grease compositions for testing were subjected to the following evaluation. Evaluation results are shown in Table 1.

In Table 1, the kinematic viscosity of the base oil was expressed by a value measured in accordance with JIS K 2283, and the pour point of the base oil was expressed by a value measured in accordance with JIS K 2269. In addition, the manufacturer and the product name of each raw material are as follows.

(1) Thickener (Raw Materials)

Alicyclic amine (cyclohexylamine)

Aromatic amine (p-toluidine)

Aliphatic amine (stearylamine)

Diisocyanate (4,4'-diphenylmethane diisocyanate)

(Thickener)

87.5 mol of alicyclic amine and 12.5 mol of aliphatic amine were mixed and the mixture was reacted with 50 mol of diisocyanate.

100 mol of aromatic amine and 50 mol of diisocyanate were reacted.

(2) Base Oil

Mineral oil (kinematic viscosity at 40° C.: 70 $mm^2/s$)

PAO (kinematic viscosity at 40° C.: 30 $mm^2/s$)

PAO (kinematic viscosity at 40° C.: 63 $mm^2/s$)

Ester (pentaerythritol ester, kinematic viscosity at 40° C.: 30 $mm^2/s$)

(3) Additives

Overbased calcium sulfonate ("BRYTON C-400C" manufactured by Chemtura Corporation, calcium salt of overbased alkylbenzenesulfonic acid in which the number of carbon atoms in the alkyl moiety in $R^1$ of the general formula (B) is mainly 10 to 16 (base number: 405); in the product, calcium salts of alkylbenzenesulfonic acid whose number of carbon atoms in the alkyl moiety is not 10 to 16 and whose structure cannot be specified are included, and the overbased calcium sulfonate includes calcium sulfonate and calcium carbonate)

Phosphite ("JP-260" manufactured by Johoku Chemical Industry Co., Ltd.)

Amine phosphate ("Vanlube 672" manufactured by R. T. Vanderbilt Company)

ZnDTC ("Vanlube AZ" manufactured by R. T. Vanderbilt Company)

Hydrocarbon-based wax (polyethylene wax, "LICOWAX PE 190 POWDER" manufactured by Clariant Japan KK)

Lithium Stearate

Example 1

A poly-α-olefin (PAO) having a kinematic viscosity at 40° C. of 30 $mm^2/s$ and a pentaerythritol ester having a kinematic viscosity at 40° C. of 30 $mm^2/s$ were mixed at a mass ratio of 90:10 to obtain a first mixed oil. The kinematic viscosity at 40° C. of the first mixed oil is 30 $mm^2/s$. The kinematic viscosity at −30° C. of the first mixed oil is 2450 $mm^2/s$. 4,4'-diphenylmethane diisocyanate was added to a part of the first mixed oil and the mixture was heated to 70° C. to 80° C. and dissolved with stirring to obtain a first mixture. Meanwhile, cyclohexylamine and stearylamine were added to a part of the first mixed oil at a molar ratio of 87.5:12.5, and the mixture was heated to 70° C. to 80° C. and dissolved with stirring to obtain a second mixture. Next, while maintaining the temperature of the first mixture and the temperature of the second mixture, the second mixture was added to the first mixture, and the mixture was heated to raise the temperature with stirring. At first, the temperature was maintained at 100° C. to 110° C. with continuous stirring for 30 minutes to allow the reaction of the mixture to proceed, and then, the temperature was raised to 160° C. to 170° C. with continuous stirring, followed by cooling to obtain a first product. After cooling, overbased calcium sulfonate was added to the first product such that the final content in the grease composition was 2.0 mass %, amine phosphate was added to the first product such that the final content in the grease composition was 1.0 mass %, and a semi-solid wax melt, which was obtained by adding polyethylene wax to a part of the first mixed oil, heating to 120° C. to 130° C. and dissolving with stirring, and cooling to room temperature while continuing to stir, was added to the first product such that the final content of the polyethylene wax in the grease composition was 1.0 mass %, and then, a part of the first mixed oil was added to the first product to adjust consistency, and the resultant was kneaded with a three-roll mill, thereby obtaining a grease composition of Example 1. The thickener in the grease composition of Example 1 is diurea shown in the formula (C).

[Chem. 4]

Formula (C)

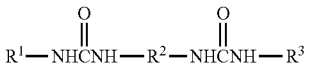

(In the formula, $R^2$ represents a diphenylmethane group, each of N atoms bonded to each of phenyl groups of $R^2$ is located at the para position of a methylene group of the diphenylmethane group, $R^1$ and $R^3$ are the same or different functional groups and each represent a cyclohexyl group or an octadecyl group, and a ratio of the number of moles of cyclohexyl group to the total number of moles of cyclohexyl group and octadecyl group [{(number of cyclohexyl groups)/(number of cyclohexyl groups+number of octadecyl groups)}×100] is 87.5 mol %.)

Example 2

A poly-α-olefin (PAO) having a kinematic viscosity at 40° C. of 30 $mm^2/s$, a poly-α-olefin (PAO) having a kinematic viscosity at 40° C. of 63 $mm^2/s$, and a pentaerythritol ester having a kinematic viscosity at 40° C. of 30 $mm^2/s$ were mixed at a mass ratio of 25:65:10 to obtain a second mixed oil. The kinematic viscosity at 40° C. of the second mixed oil is 50 $mm^2/s$. The kinematic viscosity at −30° C. of the second mixed oil is 4820 $mm^2/s$. 4,4'-diphenylmethane diisocyanate was added to a part of the second mixed oil and the mixture was heated to 70° C. to 80° C. and dissolved with stirring to obtain a third mixture. Meanwhile, cyclohexylamine and stearylamine were added to a part of the mixed oil at a molar ratio of 87.5:12.5, and the mixture was heated to 70° C. to 80° C. and dissolved with stirring to obtain a fourth mixture. Next, while maintaining the temperature of the third mixture and the temperature of the fourth mixture, the fourth mixture was added to the third mixture, and the mixture was heated to raise the temperature with stirring. At first, the temperature was maintained at 100° C. to 110° C. with continuous stirring for 30 minutes to allow the reaction of the mixture to proceed, then the temperature was raised to 160° C. to 170° C. with continuous stirring, followed by cooling to obtain a second product. After cooling, overbased calcium sulfonate was added to the second product such that the final content in the grease composition was 2.0 mass %, amine phosphate was added to the second product such that the final content in the grease composition was 1.0 mass %, and a semi-solid wax melt, which was obtained by adding polyethylene wax to a part of the second mixed oil, heating to 120° C. to 130° C. and dissolving with stirring, and cooling to room temperature while continuing to stir, was added to the second product such that the final content of the polyethylene wax in the grease composition was 1.0 mass %, and then, a part of the second mixed oil was added to the second product to adjust consistency, and the resultant was kneaded with a three-roll mill, thereby obtaining a grease composition of Example 2. The thickener in the grease composition of Example 2 is diurea shown in the formula (D).

[Chem. 5]

Formula (D)

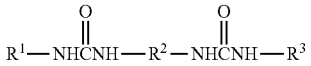

(In the formula, $R^2$ represents a diphenylmethane group, each of N atoms bonded to each of phenyl groups of $R^2$ is located at the para position of a methylene group of the diphenylmethane group, $R^1$ and $R^3$ are the same or different functional groups and each represent a cyclohexyl group or an octadecyl group, and a ratio of the number of moles of cyclohexyl group to the total number of moles of cyclohexyl group and octadecyl group [{(number of cyclohexyl groups)/(number of cyclohexyl groups+number of octadecyl groups)}×100] is 87.5 mol %.)

Example 3

A poly-α-olefin (PAO) having a kinematic viscosity at 40° C. of 30 $mm^2/s$, and a pentaerythritol ester having a kinematic viscosity at 40° C. of 30 $mm^2/s$ were mixed at a mass ratio of 90:10 to obtain a third mixed oil. The kinematic viscosity at 40° C. of the third mixed oil is 30 $mm^2/s$. The kinematic viscosity at −30° C. of the third mixed oil is 2450 $mm^2/s$. 4,4'-diphenylmethane diisocyanate was added to a part of the third mixed oil and the mixture was heated to 70° C. to 80° C. and dissolved with stirring to obtain a fifth mixture. Meanwhile, cyclohexylamine and stearylamine were added to a part of the third mixed oil at a molar ratio of 87.5:12.5, and the mixture was heated to 70° C. to 80° C. and dissolved with stirring to obtain a sixth mixture. Next, while maintaining the temperature of the fifth mixture and the temperature of the sixth mixture, the sixth mixture was added to the fifth mixture, and the mixture was heated to raise the temperature with stirring. At first, the temperature was maintained at 100° C. to 110° C. with continuous stirring for 30 minutes to allow the reaction of the mixture to proceed, then the temperature was raised to 160° C. to 170° C. with continuous stirring, followed by cooling to obtain a third product. After cooling, overbased calcium sulfonate was added to the third product such that the final content in the grease composition was 2.0 mass %, phosphite was added to the third product such that the final content in the grease composition was 1.0 mass %, and a semi-solid wax melt, which was obtained by adding polyethylene wax to a part of the third mixed oil, heating to 120° C. to 130° C. and dissolving with stirring, and cooling to room temperature while continuing to stir, was added to the third product such that the final content of the polyethylene wax in the grease composition was 1.0 mass %, and then, a part of the third mixed oil was added to the third product to adjust consistency, and the resultant was kneaded with a three-roll mill, thereby obtaining a grease composition of Example 3.

The thickener in the grease composition of Example 3 is a thickener shown in the formula (E).

[Chem. 6]

Formula (E)

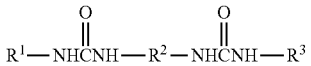

(In the formula, $R^2$ represents a diphenylmethane group, each of N atoms bonded to each of phenyl groups of $R^2$ is located at the para position of a methylene group of the diphenylmethane group, $R^1$ and $R^3$ are the same or different functional groups and each represent a cyclohexyl group or an octadecyl group, and a ratio of the number of moles of cyclohexyl group to the total number of moles of cyclohexyl group and octadecyl group [{(number of cyclohexyl groups)/(number of cyclohexyl groups+number of octadecyl groups)}×100] is 87.5 mol %.)

Comparative Example 1

4,4'-Diphenylmethane diisocyanate was added to a mineral oil having a kinematic viscosity at 40° C. of 70 $mm^2/s$ and the mixture was heated to 70° C. to 80° C. and dissolved with stirring to obtain a seventh mixture. The mineral oil solidifies at −30° C. Meanwhile, p-toluidine was added to the mineral oil, and the mixture was heated to 70° C. to 80° C. and dissolved with stirring to obtain an eighth mixture. Next, while maintaining the temperature of the seventh mixture and the temperature of the eighth mixture, the eighth mixture was added to the seventh mixture, and the mixture was heated to raise the temperature with stirring. At first, the temperature was maintained at 100° C. to 110° C. with continuous stirring for 30 minutes to allow the reaction of the mixture to proceed, then the temperature was raised to 160° C. to 170° C. with continuous stirring, followed by cooling to obtain a fourth product. After cooling, ZnDTC (zinc dithiocarbamate) was added to the fourth product such that the final content in the grease composition was 1.0 mass %, and a mineral oil was added to the fourth product to adjust consistency, and the resultant was kneaded with a three-roll mill, thereby obtaining a grease composition of Comparative Example 1. The thickener in the grease composition of Comparative Example 1 is diurea shown in the formula (F).

[Chem. 7]

Formula (F)

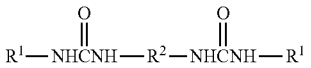

(In the formula, $R^2$ represents a diphenylmethane group, each of N atoms bonded to each of phenyl groups of $R^2$ is located at the para position of a methylene group of the diphenylmethane group, $R^1$ represents a 4-methyl benzene group.)

Comparative Example 2

4,4'-Diphenylmethane diisocyanate was added to a pentaerythritol ester having a kinematic viscosity at 40° C. of 30 $mm^2/s$ and a kinematic viscosity at −30° C. of 4510 $mm^2/s$ and the mixture was heated to 70° C. to 80° C. and dissolved with stirring to obtain a ninth mixture. Meanwhile, cyclohexylamine and stearylamine were added to the pentaerythritol ester at a molar ratio of 87.5:12.5, and the mixture was heated to 70° C. to 80° C. and dissolved with stirring to obtain a tenth mixture. Next, while maintaining the temperature of the ninth mixture and the temperature of the tenth mixture, the tenth mixture was added to the ninth mixture, and the mixture was heated to raise the temperature with stirring. At first, the temperature was maintained at 100° C. to 110° C. with continuous stirring for 30 minutes to allow the reaction of the mixture to proceed, then the temperature was raised to 160° C. to 170° C. with continuous stirring, followed by cooling to obtain a fifth product. After cooling, overbased calcium sulfonate was added to the fifth product such that the final content in the grease composition was 2.0 mass %, amine phosphate was added to the fifth product such that the final content in the grease composition was 1.0 mass %, and lithium stearate was added to the fifth product such that the final content in the grease composition was 1.0 mass %, and then, the pentaerythritol ester was added to the fifth product to adjust consistency, and the resultant was kneaded with a three-roll mill, thereby obtaining a grease composition of Comparative Example 2. The thickener in the grease composition of Comparative Example 2 is diurea shown in the formula (G).

[Chem. 8]

Formula (G)

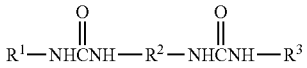

(In the formula, $R^2$ represents a diphenylmethane group, each of N atoms bonded to each of phenyl groups of $R^2$ is located at the para position of a methylene group of the diphenylmethane group, $R^1$ and $R^3$ are the same or different functional groups and each represent a cyclohexyl group or an octadecyl group, and a ratio of the number of moles of cyclohexyl group to the total number of moles of cyclohexyl group and octadecyl group [{(number of cyclohexyl groups)/(number of cyclohexyl groups+number of octadecyl groups)}×100] is 87.5 mol %.)

Comparative Example 3

4,4'-Diphenylmethane diisocyanate was added to poly-α-olefin (PAO) having a kinematic viscosity at 40° C. of 30 $mm^2/s$ and a kinematic viscosity at −30° C. of 2320 $mm^2/s$ and the mixture was heated to 70° C. to 80° C. and dissolved with stirring to obtain an eleventh mixture. Meanwhile, cyclohexylamine and stearylamine were added to the PAO having a kinematic viscosity at 40° C. of 30 $mm^2/s$ at a molar ratio of 87.5:12.5, and the mixture was heated to 70° C. to 80° C. and dissolved with stirring to obtain a twelfth mixture. Next, while maintaining the temperature of the eleventh mixture and the temperature of the twelfth mixture, the twelfth mixture was added to the eleventh mixture, and the mixture was heated to raise the temperature with stirring. At first, the temperature was maintained at 100° C. to 110° C. with continuous stirring for 30 minutes to allow the reaction of the mixture to proceed, then the temperature was raised to 160° C. to 170° C. with continuous stirring, followed by cooling to obtain a sixth product. After cooling, overbased calcium sulfonate was added to the sixth product such that the final content in the grease composition was 2.0 mass %, then the PAO having a kinematic viscosity at 40° C. of 30 $mm^2/s$ was added to the sixth product to adjust consistency, and the resultant was kneaded with a three-roll mill, thereby obtaining a grease composition of Comparative Example 3. The thickener in the grease composition of Comparative Example 3 is diurea shown in the formula (H).

[Chem. 9]

Formula (H)

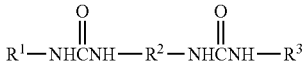

(In the formula, $R^2$ represents a diphenylmethane group, each of N atoms bonded to each of phenyl groups of $R^2$ is located at the para position of a methylene group of the diphenylmethane group, $R^1$ and $R^3$ are the same or different functional groups and each represent a cyclohexyl group or an octadecyl group, and a ratio of the number of moles of cyclohexyl group to the total number of moles of cyclohexyl group and octadecyl group [{(number of cyclohexyl groups)/(number of cyclohexyl groups+number of octadecyl groups)}×100] is 87.5 mol %.)

<Evaluation>

(1) Measurement of Bearing Torque 2 grams of a grease composition obtained in each of Examples and Comparative Examples was enclosed in a rolling bearing (6204). The rolling bearing was rotated under the conditions of a rotational speed of 4,000 rpm, no load and room temperature, and a torque value after 0.5 hours of rotation was measured. Evaluation results are expressed by relative values to a torque value in Comparative Example 1 as a reference value (=1).

(2) Measurement of Frictional Coefficient

As for a grease composition obtained in each of Examples and Comparative Examples, a frictional coefficient was measured by a reciprocating sliding-friction testing machine under the conditions of a surface pressure of 1.7 GPa, an amplitude of 1.5 mm, a frequency of 50 Hz, and an atmosphere temperature of 40° C. The measuring time was 10 minutes, and an average value of frictional coefficients measured for the last one minute was regarded as a measured value.

(3) Seizure Testing 1.8 grams of a grease composition obtained in each of Examples and Comparative Examples was enclosed in a rolling bearing (6204). The rolling bearing was rotated under the conditions of a rotational speed of 10,000 rpm, an axial load (Fa) of 67 N, a radial load (Fr) of 67 N, and a bearing temperature of 150° C., and a period until seizure occurred was measured. Evaluation results are expressed by relative values to a period until seizure occurred in Comparative Example 1 as a reference value (=1). In Examples 1 to 3 and Comparative Example 3, no seizure occurred even when a period (relative value) in Table 1 had passed, and thus, the operation of the testing machine was stopped.

(4) Separation Life Testing 1

20 grams of each of the grease compositions obtained in Examples and Comparative Examples was subjected to a rolling four-ball test, using Φ15.88 ball for the upper ball formed by JIS SUJ2 and Φ15 ball for the lower ball formed by JIS SUJ2. The contact surface pressure between balls was set to 6.5 GPa, and the bearing was rotated at room temperature without heating and a period until separation occurred was measured. Evaluation results are expressed by relative values to a period until separation occurred in Comparative Example 1 as a reference value (=1).

(5) Separation Life Testing 2

Further, in another separation life testing, 14 g of a grease composition obtained in each of Examples and Comparative Examples was enclosed in a rolling bearing (DAC4378). The rolling bearing was rotated under the conditions of a rotational speed of 300 rpm, an axial load (Fa) of 8 kN, a radial load (Fr) of 8 kN, and room temperature, and a period until seizure occurred was measured. Evaluation results are expressed by relative values to a period until separation occurred in Comparative Example 1 as a reference value (=1).

Figure 4:
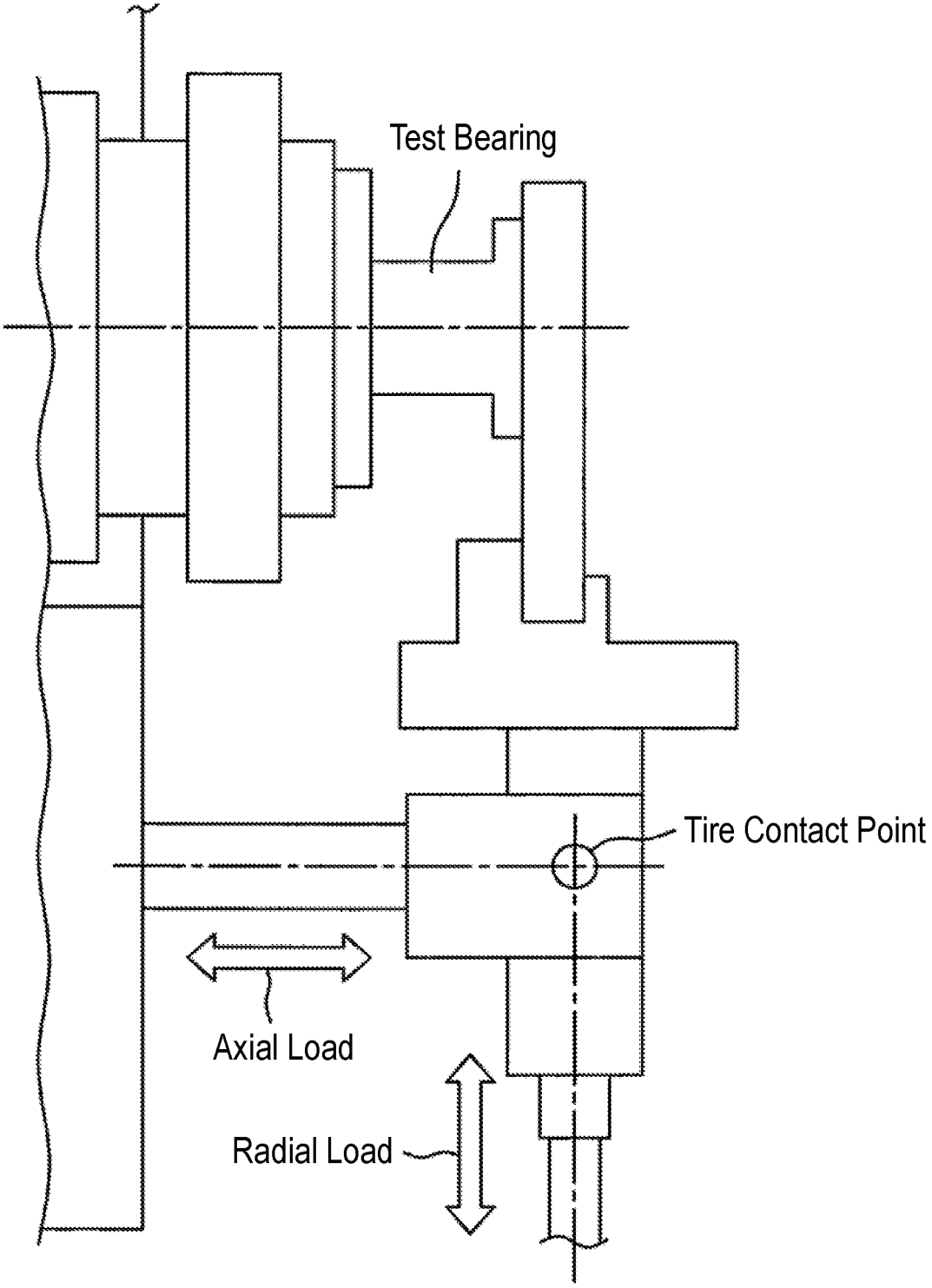
FIG. 4 is a diagram showing a configuration of a low-temperature fretting tester.

(6) Low-Temperature Fretting Testing 14 grams of a grease composition obtained in each of Examples and Comparative Examples was enclosed in a rolling bearing (DAC4378). The rolling bearing was set in a fretting tester shown in FIG. 4. The rolling bearing was oscillated under the conditions of a frequency of 4 Hz, an axial load (Fa) of ±1.4 kN, a radial load (Fr) of 5.5±4.4 kN, and a bearing temperature of −40° C. so as to reach 1,000,000 cycles in which the rolling bearing was oscillated with the aforementioned amplitude under the aforementioned axial load and radial load were shaken in each cycle. Then, depth of fretting wear generated in a raceway surface of the bearing was measured. Each valuation result is expressed by the ratio of the maximum wear depth generated on the raceway surface.

TABLE 1

| | | Example 1 | Example 2 | Example 3 | Comparative Example 1 | Comparative Example 2 | Comparative Example 3 |
|---|---|---|---|---|---|---|---|
| Thickener | 4,4'-Diphenylmethane diisocyanate | 50 | 50 | 50 | 50 | 50 | 50 |
| Mole ratio of raw materials | Cyclohexylamine | 87.5 | 87.5 | 87.5 | — | 87.5 | 87.5 |
| | p-Toluidine | — | — | — | 100 | — | — |
| | Stearylamine | 12.5 | 12.5 | 12.5 | — | 12.5 | 12.5 |
| Thickener amount, mass %*1 | | 11 | 11 | 11 | 20 | 11 | 11 |
| Base oil Mass ratio | Mineral oil | — | — | — | 100 | — | — |
| | PAO | 90 | 90 | 90 | — | — | 100 |
| | Ester | 10 | 10 | 10 | — | 100 | — |
| Kinematic viscosity of base oil | 40° C. $mm^2/s$ | 30 | 50 | 30 | 70 | 30 | 30 |
| | −30° C. $mm^2/s$ | 2450 | 4820 | 2450 | Solidified | 4510 | 2320 |
| Additives*1 | Overbased calcium sulfonate | 2.0 | 2.0 | 2.0 | — | 2.0 | 2.0 |
| | Phosphite | — | — | 1.0 | — | — | — |
| | Aminephospate | 1.0 | 1.0 | — | — | 1.0 | — |
| | ZnDTC | — | — | — | 1.0 | — | — |
| | Polyethylene wax | 1.0 | 1.0 | 1.0 | — | — | — |
| | Lithium Stearate | — | — | — | — | 1.0 | — |
| Bearing torque (Comparative Example 1 = 1) | | 0.6 | 0.7 | 0.6 | 1 | 0.7 | 0.6 |
| Pour point of base oil, ° C. | | −55 | −55 | −55 | −15 | −50 | −55 |
| Traction coefficient of base oil | | 0.06 | 0.07 | 0.06 | 0.10 | 0.07 | 0.06 |
| Friction coefficient | | 0.09 | 0.10 | 0.09 | 0.13 | 0.10 | 0.09 |
| Seizure life ratio (Comparative Example 1 = 1) | | 2.0 | 2.0 | 2.0 | 1 | 1.8 | 1.5 |
| Separation life ratio (1) (Comparative Example 1 = 1) | | 1.2 | 1.2 | 1.0 | 1 | 0.7 | 0.5 |
| Separation life ratio (2) (Comparative Example 1 = 1) | | 1.1 | 1.1 | 1.0 | 1 | 0.5 | 0.4 |
| Low temperature fretting (maximum wear depth ratio) | | 0.3 | 0.5 | 0.5 | 1 | 0.5 | 0.8 |

*1mass % based on the total mass of the grease composition

As shown in Table 1, in the bearing in which the grease composition in each of Examples 1 to 3 was enclosed, good results were obtained in all the evaluation items of the seizure life ratio, the separation life ratio and the low-temperature fretting in spite of using the base oils having a relatively low kinematic viscosity of 30 $mm^2/s$ at 40° C. or 50 $mm^2/s$ at 40° C. It was therefore found that it is possible to both reduce frictional resistance in a sliding part of a bearing and maintain seizure resistance and a long-time lubrication life of the bearing, and it is also possible to reduce occurrence of fretting under a low temperature environment.

DESCRIPTION OF REFERENCE NUMERALS AND SIGNS

1: Hub unit

G: Grease

The invention claimed is:

1. A hub unit in which a grease composition is enclosed, the hub unit comprising:

a hub wheel;

an outer ring;

an inner ring member;

a plurality of balls; and two seal members, wherein the grease composition is enclosed in an annular space formed by the outer ring, the hub wheel, and the two seal members, wherein the grease composition comprises a base oil, a thickener, and an additive, wherein:

the base oil contains a synthetic oil;

the thickener contains a compound having a urea group; and the additive contains a phosphoric compound, a calcium-based compound, and a hydrocarbon-based wax; wherein the synthetic oil is a mixed oil including a poly alpha olefin oil and an ester oil;

the ester oil is a pentaerythritol ester;

a ratio of the ester oil to the base oil is 5 to 15 mass %, and a ratio of the poly alpha olefin oil to the base oil is 85 to 95 mass %;

the phosphoric compound is an amine phosphate;

a content of the amine phosphate in the grease composition is 0.05 to 5 mass %;

the calcium-based compound is an overbased calcium sulfonate;

the overbased calcium sulfonate has a base number of 50 to 500 mgKOH/g;

a content of the overbased calcium sulfonate in the grease composition is 0.05 to 5 mass %;

the hydrocarbon-based wax is-consists of a polyethylene wax; and a content of the polyethylene wax in the grease composition is 0.05 to 5 mass %.

2. The hub unit according to claim 1, wherein the compound having a urea group includes a diurea represented by the following formula (A):

[Chem. 1]

Formula (A)

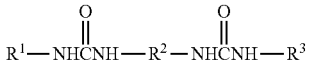

wherein $R^2$ represents a diphenylmethane group, each of N atoms bonded to each of phenyl groups of $R^2$ is located at the para position of a methylene group of the diphenylmethane group, $R^1$ and $R^3$ are the same or different functional groups and each represent a cyclohexyl group or a linear or branched alkyl group having 16 to 20 carbon atoms, and a ratio of the number of moles of cyclohexyl group to the total number of moles of cyclohexyl group and alkyl group [{(number of cyclohexyl groups)/(number of cyclohexyl groups+number of alkyl groups)}×100] is 50 to 90 mol %.

3. The hub unit according to claim 1, wherein the base oil has a kinematic viscosity at −30° C. of 5000 $mm^2/s$ or less.

4. The hub unit according to claim 1, wherein the base oil has a kinematic viscosity at 40° C. of 20 to 50 $mm^2/s$.

5. The hub unit according to claim 1, wherein a content of the compound having a urea group in the grease composition is 5 to 15 mass %.

6. The hub unit according to claim 2, wherein the base oil has a kinematic viscosity at −30° C. of 5000 $mm^2/s$ or less.

7. The hub unit according to claim 2, wherein the base oil has a kinematic viscosity at 40° C. of 20 to 50 $mm^2/s$.

8. The hub unit according to claim 3, wherein the base oil has a kinematic viscosity at 40° C. of 20 to 50 $mm^2/s$.

9. The hub unit according to claim 6, wherein the base oil has a kinematic viscosity at 40° C. of 20 to 50 $mm^2/s$.

10. The hub unit according to claim 2, wherein:

the content of the amine phosphate in the grease composition is 0.5 to 2 mass %.

11. The hub unit according to claim 3, wherein:

the content of the amine phosphate in the grease composition is 0.5 to 2 mass %.

12. The hub unit according to claim 4, wherein:

the content of the amine phosphate in the grease composition is 0.5 to 2 mass %.

13. The hub unit according to claim 6, wherein:

the content of the amine phosphate in the grease composition is 0.5 to 2 mass %.

14. The hub unit according to claim 7, wherein:

the content of the amine phosphate in the grease composition is 0.5 to 2 mass %.

15. The hub unit according to claim 8, wherein:

the content of the amine phosphate in the grease composition is 0.5 to 2 mass %.

16. The hub unit according to claim 1, wherein the relative amount of poly alpha olefin oil and ester oil to 90:10, respectively.

* * * * *